US005454729A

United States Patent [19]

Wen-Te

[11] Patent Number: 5,454,729

[45] Date of Patent: Oct. 3, 1995

[54] ELECTRIC PLUG AND SOCKET CONNECTING MECHANISM

[76] Inventor: Chuang Wen-Te, No. 16, Lane 727, Yen Ping Road, Section 2, Hsin Chu City, Taiwan

[21] Appl. No.: 207,572

[22] Filed: Mar. 7, 1994

[51] Int. Cl.[6] ..... H01R 13/627

[52] U.S. Cl. ..... 439/357; 439/369

[58] Field of Search ..... 439/345, 346, 439/355, 357, 358, 369

[56] References Cited

U.S. PATENT DOCUMENTS

| | | | |
|---|---|---|---|
| 2,732,531 | 1/1956 | Janowiec | 439/346 |
| 4,097,105 | 6/1978 | Zumwalt | 439/369 |
| 4,514,026 | 4/1985 | Herbert | 439/369 X |
| 4,917,625 | 4/1990 | Haile | 439/369 X |
| 5,286,213 | 2/1994 | Altergott et al. | 439/346 X |

*Primary Examiner*—Khiem Nguyen
*Attorney, Agent, or Firm*—Andrus, Sceales, Starke & Sawall

[57] ABSTRACT

A connecting mechanism for an electric plug and socket comprises a plug member which defines a plug housing thereof. A pair of legs are disposed and fixed within the plug housing. One end of the legs is connected with a conducting wire and the other end of each of the legs extends to the outside of the plug housing. A socket member defines a socket housing thereof. A pair of clamping plates with respect to said legs of the plug are disposed within said socket housing. One end of each of the clamping plates is connected with a conducting wire thereof. The socket housing further includes a pair of slot at the clamping plate and the legs of the plug can be received and retained by the clamping plate of the socket as said legs pass through the slot firstly. And a retaining means for removably attaching the plug to the socket.

4 Claims, 1 Drawing Sheet

ELECTRIC PLUG AND SOCKET CONNECTING MECHANISM

FIELD OF THE INVENTION

This invention relates to a connecting mechanism, more particularly, to a connecting mechanism for an electric plug and socket.

The appliances, such as the washing machine and the air conditioner, have become an indispensable necessity of our daily lives. Each appliance has a power cord which is connected to the appliance at one end and has a plug at the other end. The plug can be inserted into a power socket installed on the wall. By this arrangement, the appliance is powered by the power supplied from the wall socket or a socket of an extending cord and thus operates functionally. Another typical example is the Christmas lights strings. During the Christmas or a special occasion, decoration with the lights string is very popular. The special atmosphere brought by the lights string is irreplaceable.

In the very basic aspect, the lights string has a single plug which can be inserted into a wall socket or a socket of an extension cord. When, a socket is provided at the top of the plug, two lights strings can be used simultaneously. But this configuration of the plug and socket can make the lights string be connected in series. In light of this, a sole socket is added to the lights string. By this arrangement, the lights string has a plug at one end and a socket at the other end. By this provision, a plurality of lights strings can be connected in series. No doubt, this arrangement of the lights string brings much convenience to the customer. For example, ten (10) or more lights strings can be connected one by one to enclose a huge Christmas tree or hangs down from a high building. The phenomena is really magnificent and touching.

But, a difficulty in connection of this kind of arrangement has occurred. In normal, when a plug is inserted into a socket, the clamp of the socket will retain the legs of the plug thereof with a predetermined force. In most occasion, the plug will not be removed from the socket. But when a plurality of lights strings, for example, ten lights strings, are connected one by one and hanged from a building, the first plug of the first lights string will withstand the total weight of the ten lights strings. Accordingly, the first plug will be removed from the socket easily as it withstands a huge weight.

In solving this problem occurring when a plurality of lights string are connected, the worker always cut off the socket of the first lights string and the plug of the second lights string, then connect the wires directly from the cutting ends. Of course, the problem is solved, but another inconvenience is incurred when takes off the lights string from the building. If is more difficulty to separate two lights string connected by wires connection than two lights string connected by plug and socket. On the other hand, the more connection of the wires, the more defective connections may occur. A short circuit or open circuit of the lights strings will make all the lights darkly.

Even when an appliance operated through an extension cord, the plug is easily moved when the cord is pulled by a leg.

SUMMARY OF THE INVENTION

It is the object of this invention to provide a connecting mechanism for a plug and a socket, wherein the connecting mechanism may attach the plug to the socket firmly without being removed thereof.

It is a further the object of this invention to provide a connection mechanism for a plug and a socket, wherein the plug is removably inserted into the socket thereof.

In order to achieve the objects set forth, the mechanism for an electric plug and socket comprises a plug member which defines a plug housing thereof. A pair of legs are disposed and fixed within said housing. One end of said legs is connected with a conducting wire and the other end of the leg extends to the outside of the plug housing. A receiving means is provided at said housing. A socket member defines a socket housing thereof. A pair of clamping plates with respect to said legs of said plug are disposed within said plug housing. One end of said clamping plates is connected with a conducting wire thereof. Said housing further including a pair of slots above said clamping plates. Said legs can be received and retained by said clamping plates of said socket as said legs pass through said slot firstly, then received by said clamping plates. Said housing further including a retaining means. When said plug is inserted into said socket, said receiving means is retained and engaged with said retaining means to prevent said plug from being removed accidently,

BRIEF DESCRIPTION OF THE DRAWINGS

The structural and operational characteristics of the present invention and its advantages as compared to the known state of the prior art will be better understood from the following description, relating to the attached drawings which show illustratively but not restrictively an example of a connecting mechanism for an electric plug and socket. In the drawings.

DESCRIPTION OF THE PREFERABLE EMBODIMENTS

Figure 1:
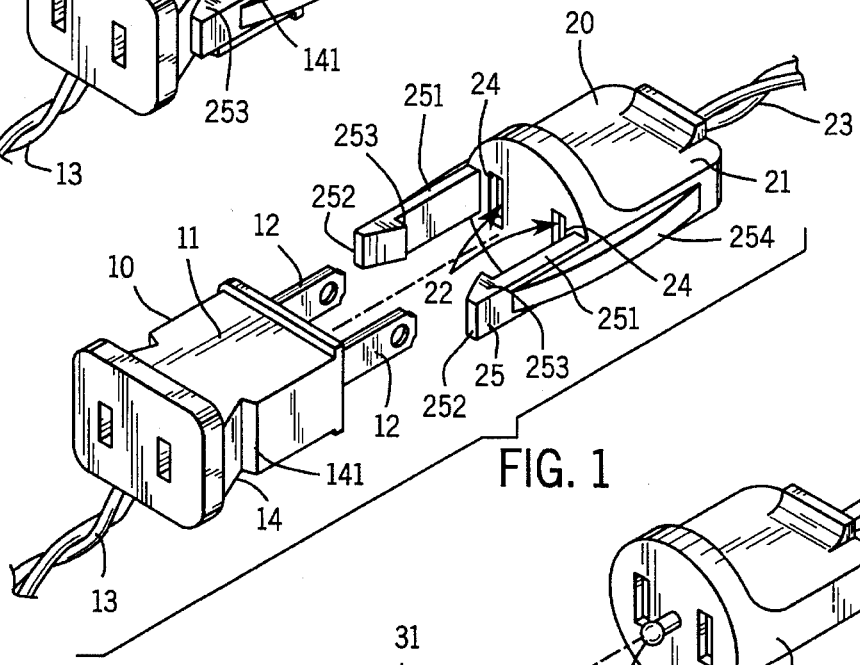
FIG. 1 is a perspective view of a plug and socket assembly equipped with a connecting mechanism thereof.

Referring to FIG. 1, a plug and socket assembly made according to this invention includes a plug 10 which defines a plug housing 11 with a rectangular configuration thereof. A pair of electrical connection legs or prongs 12 are disposed within the plug housing 11. The legs 12 are spaced apart with a standard distance. The legs 12 extend to a standard length. In general, the plug 10 has an identical configuration with a conventional plug. One end of the legs are connected with conducting wires 13. A retaining slot 14 is disposed at each side of the plug housing 11. The retaining slot 14 further includes a shoulder 141 thereof.

A socket 20 defines a rectangular socket housing 21 thereof. In general, the socket 20 has the same configuration as a conventional socket including at least a pair of clamping plates or receptacles 22, a pair of receiving slots 24 in line with the clamping plates, a pair of conducting wires 23 connected to one end of the clamping plates. All these above described socket 20 are identical with a conventional socket. The socket 20 made according to this invention includes a retaining means 25 disposed at the sides of the socket housing 21. In the preferable embodiment, the retaining means 25 is an elongate bar 251. One end of the elongate bar 251 is attached to the side of the socket housing 21 and the other end of the elongate bar 251 has a hooker 253 projected inward. For providing a further strength to the elongate bar 251, a reinforced rib 254 is disposed at the outer side of the elongate bar 251 to provide a further inward strength to the hooker 253.

When the plug 10 inserts into the socket 20 through the receiving slots 24, the legs 12 are clamped by the clamping plates. When the legs 12 are completely seated onto the socket 20, the hooker 253 of the retaining means 25 is received and retained by the shoulder 141 of the slot 14. As a result, the plug 10 is retained to the socket 20 by the engagement between the hooker 253 and the slot 14. Accordingly, the plug 10 will not be easily removed once it is completely received by the socket 20.

Figure 2:
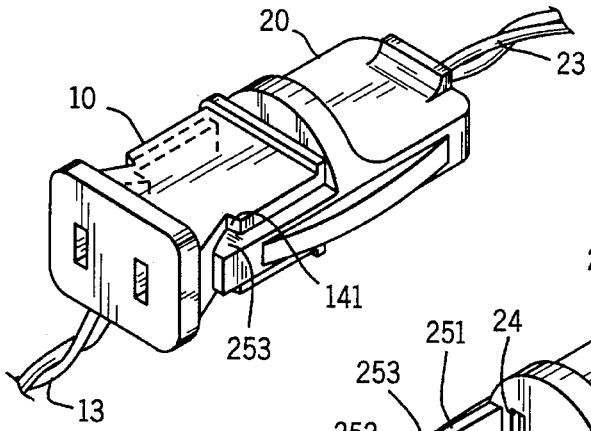
FIG. 2 is a perspective view of a plug and a socket assembly wherein the plug is retained on the socket.

As shown in FIG. 2, the plug 10 is completely received and retained by a socket 20. From FIG. 2, the plug 10 is completely seated to the socket 20. By the provision of the hooker 253, the plug 10 is not easily removed unless the hookers 253 are released from the shoulders 141 respectively.

Besides, the retaining means 25 is disposed on the socket 20. By this arrangement, the plug 10 can be received by a conventional socket, such as a wall mounted socket, without any difficulty.

Figure 3:
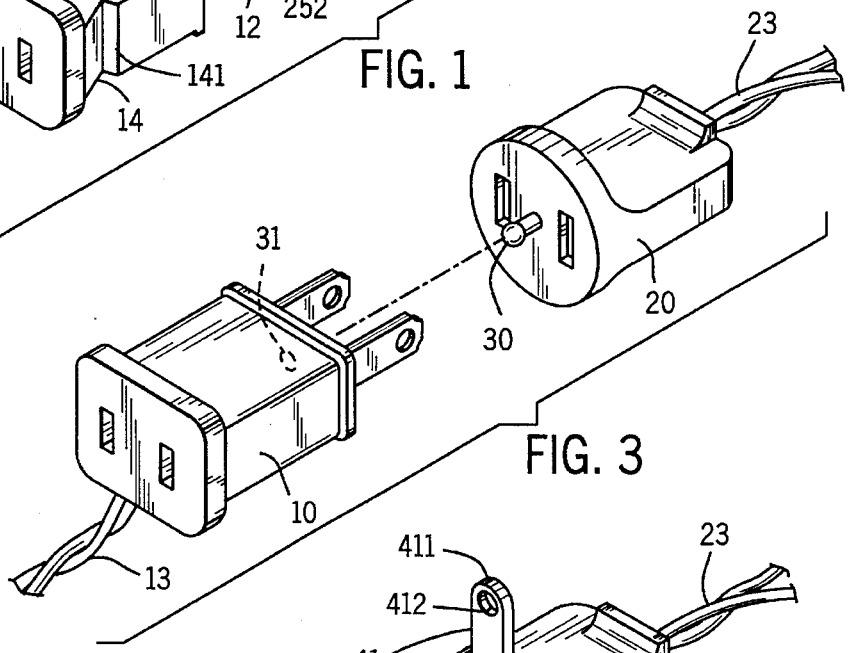
FIG. 3 is a perspective view of a second embodiment of the connecting mechanism applied to the plug and socket assembly.

FIG. 3 discloses a second embodiment of the retaining means. In this embodiment, the slot 14 is replaced by a hole 31 and the elongate bar 251 is substituted by a pin 30 with a ball head. By this arrangement, when the plug 10 inserts into the socket 20, the pin 30 with a ball head is received by the hole 31. Accordingly, the plug 10 is retained thereof.

Figure 4:
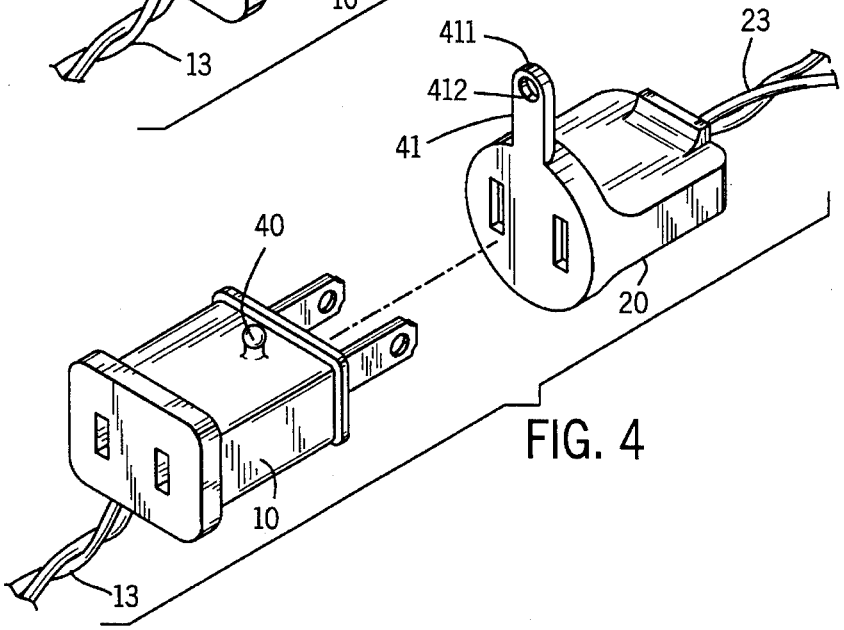
FIG. 4 is a perspective view of a third embodiment of the connecting mechanism applied to the plug and socket assembly.

FIG. 4 discloses a third embodiment of the retaining means. In this embodiment, a pin 40 with ball head is disposed on top of the plug 10. At the socket 20, a retaining plate 41 with a hole 412 at the end 411 is disposed thereof. When the plug 10 inserts into the socket 20, the retaining plate 41 can be bent down and the hole 411 can be snapped to the pin 40 with ball head.

By the provision of this invention, the problem which the plug is easily removed as an external force is applied can be totally solved. This plug and socket assembly is specially suitable for applying to the Christmas lights strings. Accordingly, the lights strings can be connected one by one easily and can be disconnected without any difficulty.

Although the present invention has been described in connection with the preferred embodiment thereof, many other variations and modifications will now become apparent to those skilled in the art without departing from the scope of the invention. It is preferred, therefore, that the present invention not be limited by the specific disclosure herein, but only by the appended claims.

I claim:

1. An electrical connector capable of resisting forces tending to separate the components thereof, said connector comprising:

a plug member having a plug housing, a pair of prongs disposed and fixed within said housing, one end of each of said prongs being connected to a conducting wire, the other end of each of said prongs extending outside of said housing at an end surface of said plug housing;

a socket member having a socket housing, a pair of receptacle means for receiving said prongs of said plug member, said receptacle means being disposed within said socket housing, an end of each of said receptacle means being connected with a conducting wire, said socket housing further including a pair of openings through which said prongs of said plug member may extend for engagement by said receptacle means of said socket member when said plug member and socket member are moved into abutment; and a retaining means comprising slots cut into opposing sides of said plug housing, said slots being located adjacent an end of said housing opposite that containing said end surface, elongated bars extending from opposing sides of said socket housing for embracing said opposing sides of said plug housing when said plug member and said socket member are moved into abutment, said elongated bars having terminal ends, hook members mounted on the ends of said elongated bars and extending into said slots for removably joining said plug member and said socket member together and for resisting forces tending to separate the plug member and said socket member, and a stiffening rib extending along each of said elongated bars for maintaining said bars in embracement with said plug housing and said hook members in engagement with said slots cut into said plug member.

2. An electrical connector capable of resisting forces tending to separate the components thereof, said connector comprising:

a plug member having a plug housing, a pair of prongs disposed and fixed within said housing, one end of each of said prongs being connected to a conducting wire, the other end of each of said prongs extending outside of said housing at an end surface of said plug housing;

a socket member having a socket housing, a pair of receptacle means for receiving said prongs of said plug member, said receptacle means being disposed within said socket housing, an end of each of said receptacle means being connected with a conducting wire, said socket housing further including a pair of openings in an end surface of said socket housing through which said prongs of said plug member may extend for engagement by said receptacle means of said socket member when said plug member and socket member are moved so that said end surfaces thereof are in abutment; and a retaining means for removably joining said plug member and said socket member together, said retaining means comprising a hole in the end surface of one of said members and a pin with ball head extending from abutting end surface of the other of said members, said pin being removeably retained in said hole when said end surfaces are in abutment.

3. An electrical connector capable of resisting forces tending to separate the components thereof, said connector comprising:

a plug member having a plug housing, a pair of prongs disposed and fixed within said housing, one end of each of said prongs being connected to a conducting wire, the other end of each of said prongs extending outside of housing;

a socket member having a socket housing, a pair of receptacle means for receiving said prongs of said plug member, said receptacle means being disposed within said socket housing, one end of each of said receptacle means being connected with a conducting wire, said socket housing further including a pair of openings through which said prongs of said plug member may extend for engagement by said receptacle means of said socket member when said plug member and socket member are moved into abutment; and a retaining means for removably attaching said plug member to said socket member, said retaining means comprising a pin with ball head on a side surface area of one of said housings and a flexible retaining plate with a hole at the end mounted on the other said housing, said retaining plate being bent to place said ball head in said hole to removeably retain said pin in said plate.

4. The electrical connector of claim 3 wherein said pin with ball head is mounted on a side surface of said plug housing wherein said socket housing has a generally planar surface abutting said plug housing when said socket housing and said plug housing are joined together, and wherein said flexible retaining plate is generally flush with said planar surface when said plate is unbent.

* * * * *